US010677433B2

(12) United States Patent
Cho et al.

(10) Patent No.: US 10,677,433 B2
(45) Date of Patent: Jun. 9, 2020

(54) LIGHTING DEVICE

(71) Applicant: Feelux Co., Ltd., Gyeonggi-do (KR)

(72) Inventors: Beom Yeon Cho, Seoul (KR); Ha Young Jhun, Gyeonggi-do (KR)

(73) Assignee: FEELUX CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/325,250

(22) PCT Filed: Aug. 31, 2017

(86) PCT No.: PCT/KR2017/009563
§ 371 (c)(1),
(2) Date: Feb. 13, 2019

(87) PCT Pub. No.: WO2018/044103
PCT Pub. Date: Mar. 8, 2018

(65) Prior Publication Data

US 2019/0178480 A1 Jun. 13, 2019

(30) Foreign Application Priority Data

Aug. 31, 2016 (KR) ..... 10-2016-0111296
Aug. 31, 2017 (KR) ..... 10-2017-0110880

(51) Int. Cl.

| | |
|---|---|
| ***F21V 21/34*** | (2006.01) |
| ***F21S 8/04*** | (2006.01) |
| ***F21V 23/02*** | (2006.01) |
| ***F21V 15/01*** | (2006.01) |
| ***F21V 19/02*** | (2006.01) |
| ***F21V 23/06*** | (2006.01) |
| ***F21V 21/30*** | (2006.01) |
| ***F21V 21/35*** | (2006.01) |

(52) U.S. Cl.
CPC ..... *F21V 21/34* (2013.01); *F21S 8/043* (2013.01); *F21V 15/01* (2013.01); *F21V 19/02* (2013.01); *F21V 21/30* (2013.01); *F21V 21/35* (2013.01); *F21V 23/02* (2013.01); *F21V 23/06* (2013.01)

(58) Field of Classification Search
CPC ..... F21V 21/34; F21V 21/35; F21V 15/01; F21V 15/015; F21V 19/02; F21V 21/30; F21V 23/02; F21S 8/043; F21S 8/066
See application file for complete search history.

(56) References Cited

U.S. PATENT DOCUMENTS

2015/0184841 A1* 7/2015 Liu ..... F21V 21/34 362/270
2015/0226384 A1* 8/2015 Park ..... F21V 21/34 362/223
2017/0082266 A1* 3/2017 Ruhland ..... F21S 8/066

FOREIGN PATENT DOCUMENTS

KR 1998-0059361 A 10/1998
KR 20-0302078 Y1 1/2003
KR 10-2009-0120885 A 11/2009
(Continued)

OTHER PUBLICATIONS

International Search Report for PCT/KR2017/009563 dated Dec. 6, 2017.

*Primary Examiner* — Y. M. Quach Lee
(74) *Attorney, Agent, or Firm* — The PL Law Group, PLLC

(57) ABSTRACT

A lighting device includes a rail unit, a body unit which emits light at an object to be lit up and is coupled to a rail unit, and a fixing unit that is fixed to the rail unit together with the body unit and guides the supply of rail unit power to the body unit.

12 Claims, 16 Drawing Sheets

(56) References Cited

FOREIGN PATENT DOCUMENTS

| | | | |
|---|---|---|---|
| KR | 10-2014-0050527 | A | 4/2014 |
| KR | 10-2015-0086843 | A | 7/2015 |
| KR | 10-2015-0088562 | A | 8/2015 |
| KR | 10-2016-0035788 | A | 4/2016 |

* cited by examiner

LIGHTING DEVICE

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2017/009563, filed Aug. 31, 2017, which claims priority to the benefit of Korean Patent Application No. 10-2016-0111296 filed on Aug. 31, 2016 and 10-2017-0110880 filed on Aug. 31, 2017 in the Korean Intellectual Property, Office the entire contents of which are incorporated herein by reference.

TECHNICAL FIELD

The present invention relates to a lighting device, and more particularly, to a lighting device which may stably implement various illuminations at various positions as needed.

BACKGROUND ART

In general, lighting lamps using light emitting diodes (LEDs) exhibit an illumination effect of high brightness using a small capacity of power power and thus have been used for various purposes, such as a decorative light and an interior lighting lamp, and, particularly, an LED lighting lamp in the form of the conventional fluorescent lamp, which is formed by coupling a tube-type fluorescent cover to a main body formed of aluminum and provided with an LED module and a printed circuit board (PCB) mounted thereon, is well known.

The background art of the present invention is disclosed in Korean Patent Laid-open Publication No. 2009-0120885 (Date of Publication: Nov. 25, 2009, Title: LED light).

DISCLOSURE

Summary

The present invention is directed to providing a lighting device which may implement illuminations in various states at various positions, have enhanced reliability, and prevent accidents.

One aspect of the present invention provides a lighting device including a body unit configured to emit light to an object to be lit up and coupled to a rail unit, and a fixing unit fixed to the rail unit together with the body unit and configured to guide power of the rail unit to be supplied to the body unit.

The rail unit may include a guide rail unit coupled to the body unit, and an electrode unit installed on the guide rail unit and configured to come into contact with a power supply unit provided on the body unit to supply power to the power supply unit.

The guide rail unit may include guide protrusions configured to form a groove into which a guide groove part protruding upward from the body unit is inserted, and engaged parts located at both sides of the guide protrusions and configured to form grooves with which engaging protrusions of the fixing unit are engaged.

The body unit may include a housing coupled to the rail unit, a substrate detachably installed on the housing, a power supply unit connected to the substrate and configured to come into contact with the rail unit to receive power, and a lighting unit electrically connected to the substrate and configured to emit light.

The lighting unit may be provided to be rotatable by a rotation unit.

The fixing unit may include a coupling unit configured to restrain the movement of the body unit connected to the rail unit and to guide the power of the rail unit to be supplied to the body unit, and an insert body unit connected to the body unit or the coupling unit and configured to reinforce coupling force between the coupling unit and the rail unit in association with the coupling unit.

The coupling unit may include a coupling body coupled to the body unit, and side wall parts provided to be spaced apart from the coupling body, and the insert body unit may be moved into receiving spaces formed between the side wall parts and the coupling body.

The coupling unit may further include connection members configured to connect the side wall parts to the coupling body.

The side wall parts may be provided to be rotated about the connection members in association with external force.

The insert body unit may be inserted into the receiving spaces formed between the side wall parts and the coupling body so that engaging protrusions provided at ends of the side wall parts are engaged with engaged parts of the rail unit.

The insert body unit may include a movable member connected to the body unit or the coupling body, and interference members configure to extend from the movable member and inserted into the receiving spaces formed between the side wall parts and the coupling body to rotate the side wall parts.

The movable member may be hinge-connected to each end of the body unit and rotated.

The movable member may be coupled to each end of the body unit to be slidably movable.

The insert body unit may further include a cover member connected to the movable member and configured to cover a side surface of the coupling unit.

Since a lighting device in accordance with the present invention can stably receive power, the lighting device can illuminate a plurality of positions or a wide area and provide light of high brightness concentratedly or selectively to a position requiring illumination.

Further, the lighting device in accordance with the present invention can maintain a neat and simple appearance while stably receiving power and reduce an influence due to interference with appendages, such as electric wires or the like during installation of the module unit.

Also, since the lighting device in accordance with the present invention can firmly maintain a coupling state between a rail unit and a coupling unit by an insert body unit provided on a body unit, the lighting device can facilitate stable power connection and prevent accidents generated due to separation of the body unit.

DETAILED DESCRIPTION

Figure 1:
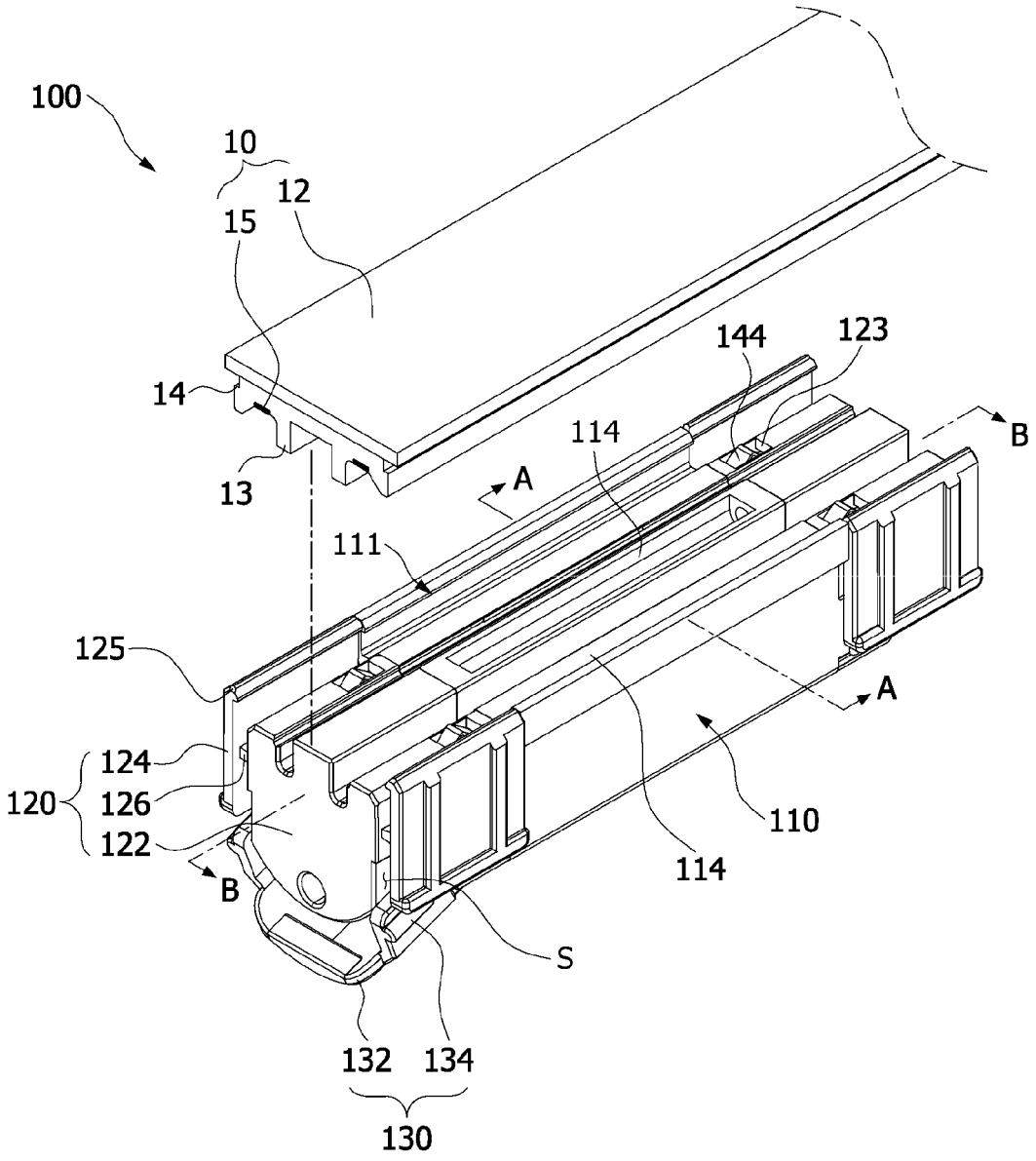
FIG. 1 is a perspective view of a lighting device in accordance with one embodiment of the present invention.

Hereinafter, a lighting device in accordance with exemplary embodiments of the present invention will be described with reference to the accompanying drawings. In the following description of the present invention, thicknesses of lines, sizes of elements, etc. shown in the drawings may be exaggerated for clarity and convenience of description.

Further, the terms used in the following description are terms defined taking into consideration the functions obtained in the present invention. The definitions of these terms should be determined based on the whole content of the description because the terms may be changed according to user's or operator's intention or a usual practice.

Figure 2:
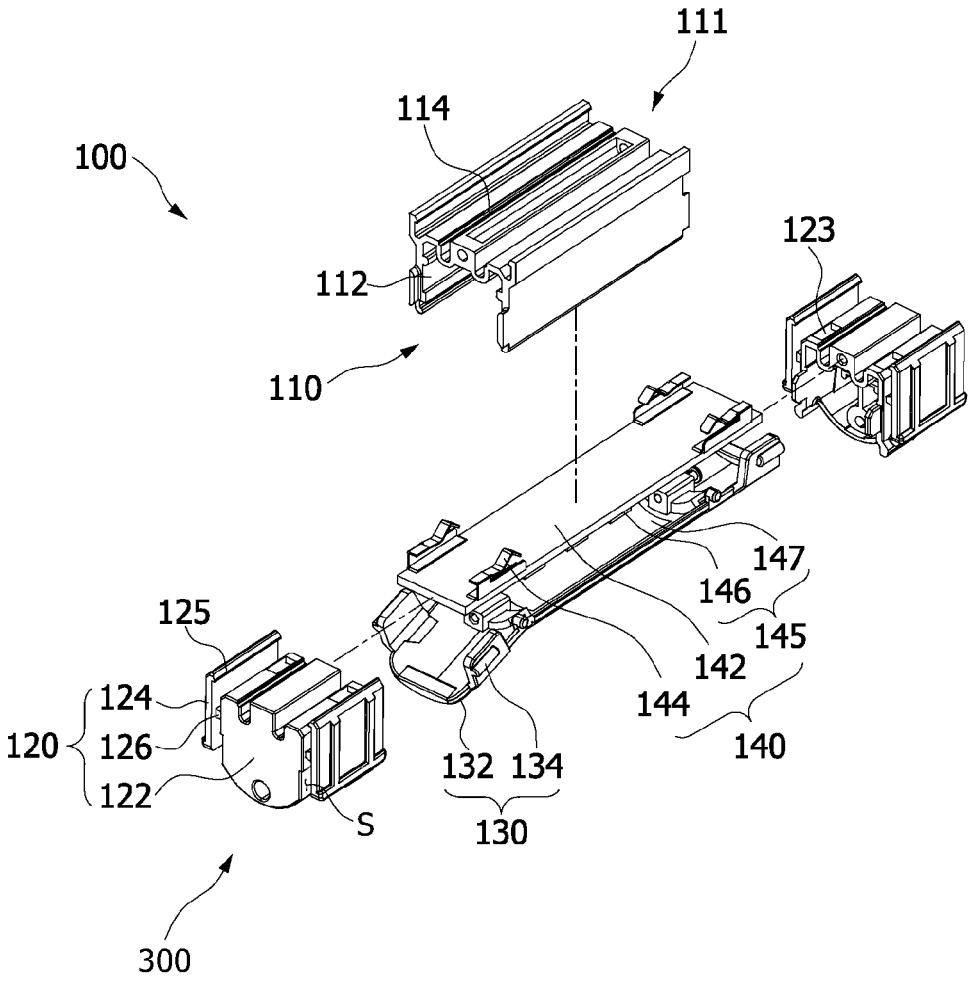
FIG. 2 is an exploded perspective view of the lighting device in accordance with one embodiment of the present invention.
Figure 3:
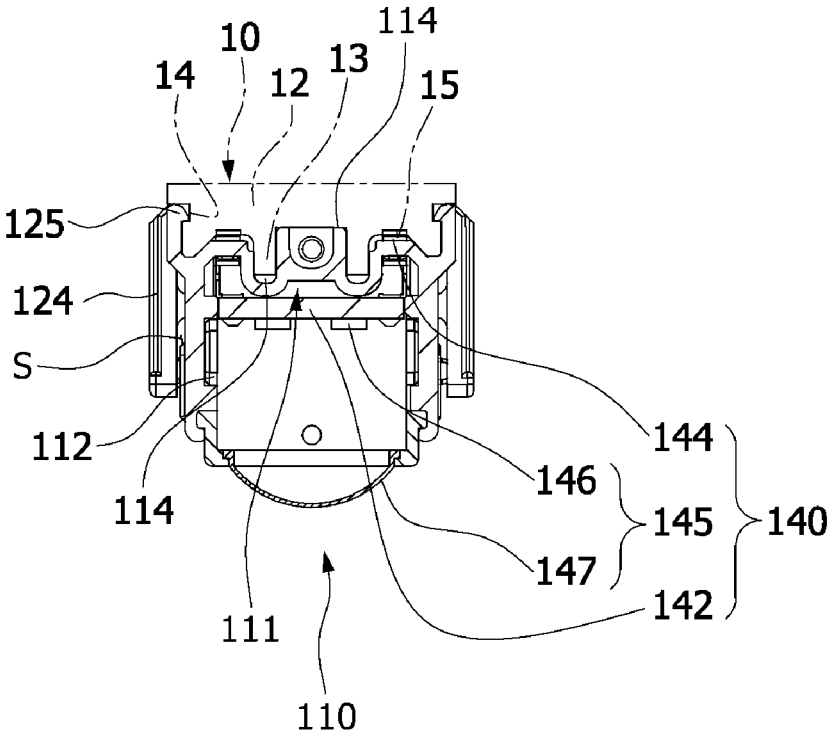
FIG. 3 is a cross-sectional view taken along line A-A of FIG. 1.
Figure 4:
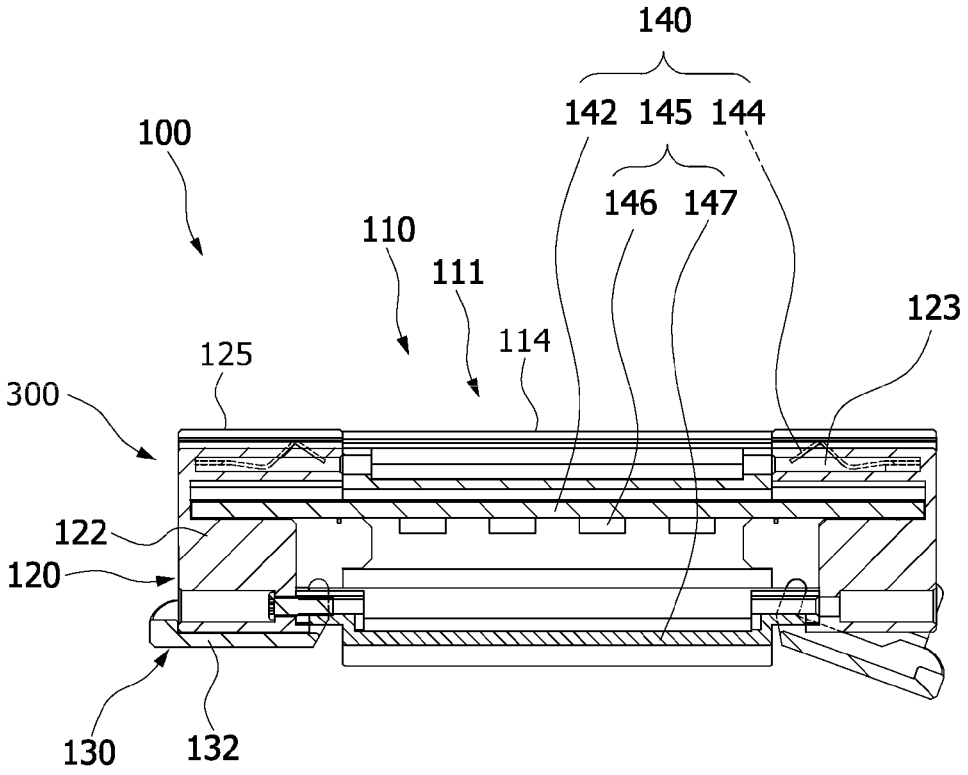
FIG. 4 is a cross-sectional view taken along line B-B of FIG. 1.
Figure 5:
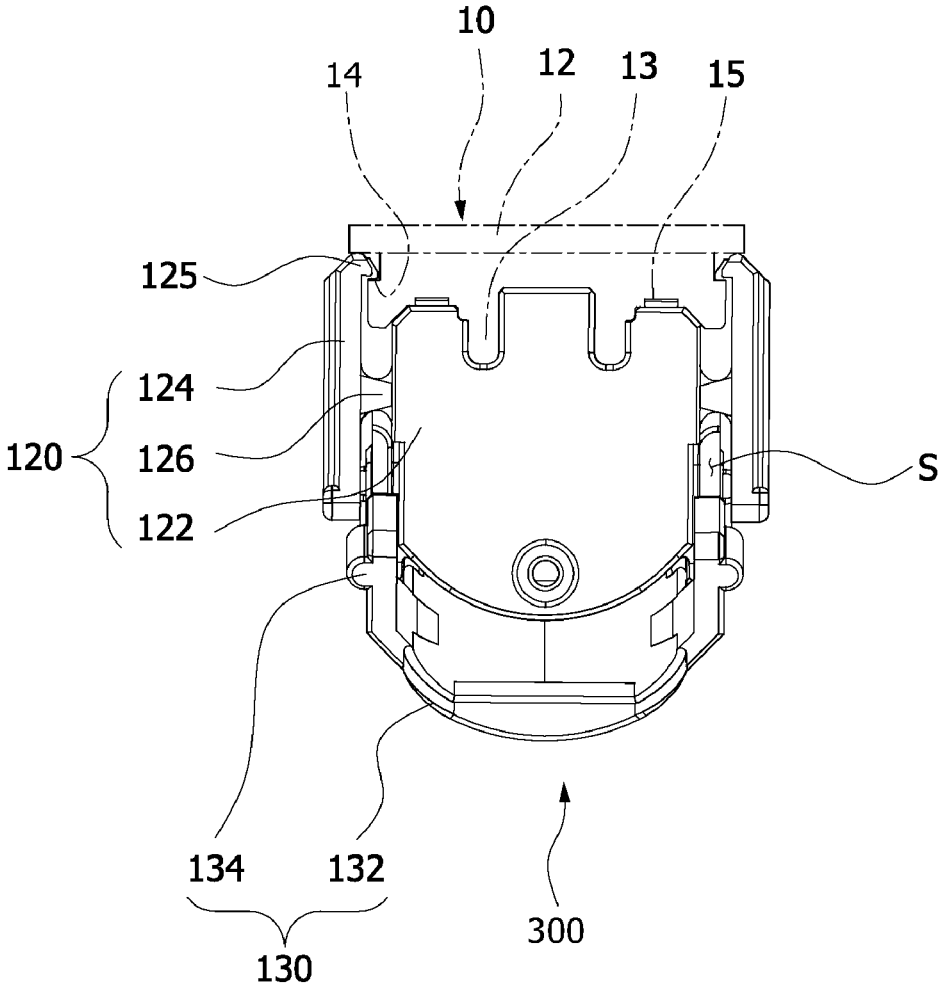
FIG. 5 is a view illustrating a state before an insert body unit is coupled to a coupling unit in accordance with one embodiment of the present invention.
Figure 6:
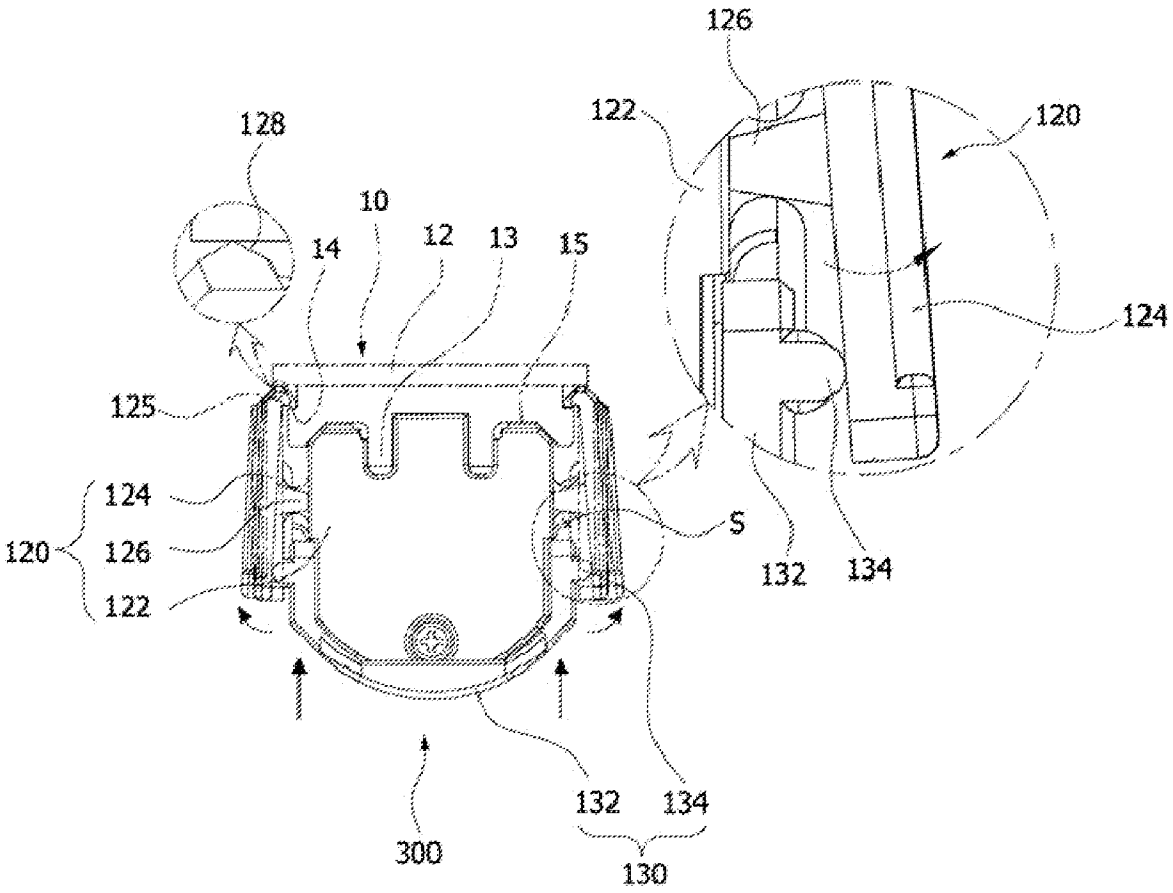
FIG. 6 is a view illustrating a state in which the insert body unit is coupled to the coupling unit in accordance with one embodiment of the present invention.
Figure 7:
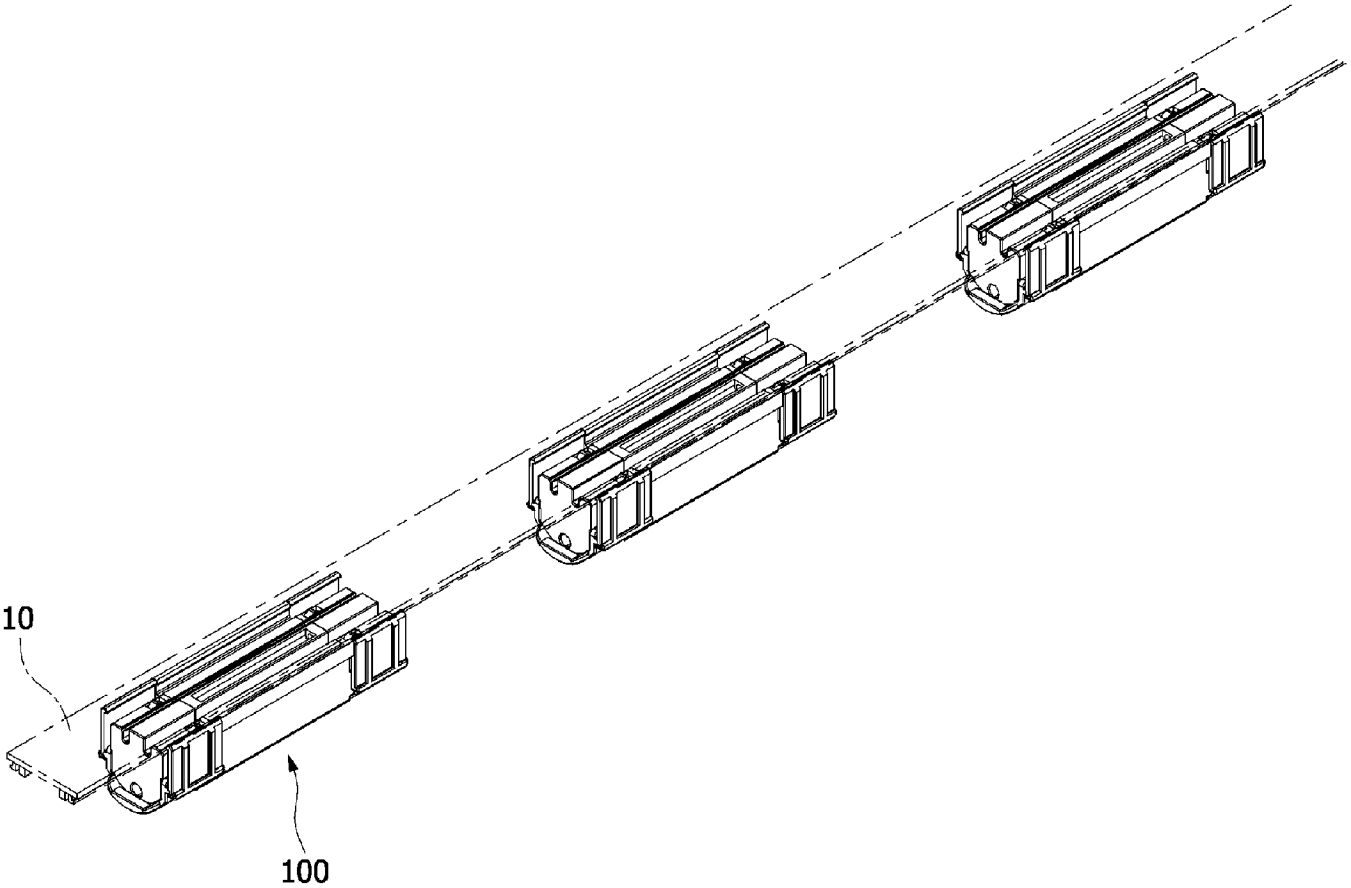
FIG. 7 is a view illustrating a usage state of the lighting device in accordance with one embodiment of the present invention.

FIG. 1 is a perspective view of a lighting device in accordance with one embodiment of the present invention, FIG. 2 is an exploded perspective view of the lighting device in accordance with one embodiment of the present invention, FIG. 3 is a cross-sectional view taken along line A-A of FIG. 1, FIG. 4 is a cross-sectional view taken along line B-B of FIG. 1, FIG. 5 is a view illustrating a state before an insert body unit is coupled to a coupling unit in accordance with one embodiment of the present invention, FIG. 6 is a view illustrating a state in which the insert body unit is coupled to the coupling unit in accordance with one embodiment of the present invention, and FIG. 7 is a view illustrating a usage state of the lighting device in accordance with one embodiment of the present invention.

As shown in FIGS. 1 to 7, a lighting device 100 in accordance with one embodiment of the present invention includes a body unit 110 configured to emit light to an object to be lit up and coupled to a rail unit 10, and a fixing unit 300 fixed to the rail unit 10 together with the body unit 110 and configured to guide power of the rail unit 10 to be supplied to the body unit 110. The object to be lit up means an object to which the lighting device 100 emits light, particularly, an unspecified space or object which is lit up.

As shown in FIGS. 1 and 2, the rail unit 10 may be modified into any shape within the scope of technical ideas provided so as to install the body unit 110, control the position of the body unit 110, and supply power to the body unit 110. The rail unit 10 in accordance with one embodiment includes a guide rail unit 12 and electrode units 15.

The guide rail unit 12 is fixedly provided on a structure (not shown) in which the lighting device 100 will be installed. This embodiment describes the lighting device 100 as being installed on a ceiling of a building. However, an installation position of the lighting device 100 is not limited to a ceiling of a building, and the lighting device 100 may be installed in structures other than a building, such as furniture or the like, or be installed on a wall or a floor surface.

The body unit 110 may be detachably coupled to the guide rail unit 12. Such coupling may be implemented by a coupling unit 120 which will be described below. The guide rail unit 12 in accordance with one embodiment may include guide protrusions 13 and engaged parts 14.

The guide protrusions 13 form a groove into which a guide groove part 114 protruding upward from the body unit 110 may be inserted. Two guide protrusions 13 protruding downward from the guide rail unit 12 are provided in a pair and extend in a length direction of the guide rail unit 12. Since the guide protrusions 13 form the groove into which the guide groove part 114 of the body unit 110 is inserted to be slidably moved therealong, the body unit 110 may easily change the installation position thereof along the rail unit 10.

The engaged parts 14 are located at both sides of the guide protrusions 13 and form grooves with which engaging protrusions 125 of the fixing unit 300 are engaged. Since the engaged parts 14 form the grooves extending in a length direction of the rail unit 10, transfer installation, in which the body unit 110 and the fixing unit 300 are slidably moved along the rail unit 10 and then fixed, may be easily carried out.

The electrode units 15 are installed under the guide rail unit 12 in the length direction of the guide rail unit 12 and come into contact with power supply units 144 provided on the body unit 110 to supply power to the power supply units 144. The electrode units 15 in accordance with one embodiment are installed on the bottom surface of the guide rail unit 12 and extend in the length direction of the guide rail unit 12 to have a length corresponding to the length of the guide rail unit 12.

The electrode units 15 are electrically connected to an external power supply device (not shown), thus receive power supplied therefrom, and come into contact with the power supply units 144 described below to be electrically connected to the power supply units 144. The electrode units 15 perform a function of supplying power to the body unit 110 detachably installed on the rail unit 10. This embodiment exemplarily describes the electrode units 15 as being formed as a metal plate formed of aluminum.

The body unit 110 may be formed to have any shape within the scope of technical ideas in which the body unit 110 may emit light to an object to be lit up and may be coupled to the rail unit 10. The body unit 110 in accordance with one embodiment includes a housing 111 coupled to the rail unit 10, and a module unit 140 detachably coupled to the housing 111 and emitting light.

Referring to FIG. 2, the body unit 110 is detachably coupled to the rail unit 10. In this embodiment, the housing 111 of the body unit 110 is formed of a nonconductor, and the module unit 140 is detachably installed on the housing 111. A substrate installation part 112 to receive a substrate 142 of the module unit 140 mounted therein is provided on the housing 111.

The guide groove part 114 is formed in the upper surface of the housing 111, and the guide protrusions 13 corresponding to the guide groove part 114 are formed on the guide rail unit 12. The guide groove part 114 and the guide protrusions 13 serve to guide the movement of the lighting device 100. Further, the upper end of the body unit 110 is coupled to the engaged parts 14 of the guide rail unit 12, which will be described below, to be slidably movable. The guide groove part 114 is formed to have a shape protruding from the center of the upper surface of the housing 111, and a long groove is formed in the guide groove part 114. The guide groove part 114 is inserted into the groove formed inside the guide protrusions 13 to be slidably movable. Since the guide groove part 114 and the guide protrusions 13 extend in the length direction of the rail unit 10, the position of the body unit 110 may be easily controlled. That is, the guide groove part 114 is inserted into the groove formed inside the guide protrusions 13 and thus slidably moved, thereby having a function of guiding the movement of the body unit 110.

The substrate installation part 112 includes a mounting groove formed in the housing 111 to fix the substrate 142. The rectangular plate-shaped substrate 142 is inserted into the housing 111 through a side surface of the housing 111 and fixed to the mounting groove provided in the substrate installation part 112, and thus, installation and replacement of the substrate 142 may be easily carried out.

As shown in FIGS. 2 and 3, the module unit 140 is detachably installed on the housing 111, and may be modified to have any shape within the scope of technical ideas in which the module unit 140 may receive power transmitted through the electrode units 15 of the rail unit 10 and then emit light. The module unit 140 in accordance with one embodiment includes the substrate 142, the power supply units 144, and a lighting unit 145.

The substrate 142 is detachably installed in the substrate installation part 112 of the housing 111, and the power supply units 144 connected to the substrate 142 come into contact with the rail unit 10 and thus receive power. Further, the lighting unit 145 is electrically connected to the substrate 142, generates light, and thus transmits the light to a space or an object to be lit up.

The substrate 142 is slidably inserted into the substrate installation part 112 of the housing 111 to be coupled to the substrate installation part 112. The power supply units 144 are provided at the edge of the upper surface of the substrate 142, as shown in FIG. 2, and are formed of a metal piece which is bent. Open holes 123 are formed in a coupling body 122 of the fixing unit 300 to expose the power supply units 144 to the outside. Here, the coupling unit 120 having the coupling body 122 and the body unit 110 are screw-coupled to each other. As shown in FIG. 4, the lower ends of the coupling body 122 and the body unit 110 are screw-coupled to each other, coupling between the upper ends thereof is reinforced by coupling between the open holes 123 and the power supply units 144 formed of the metal piece which is bent, and the coupling body 122 and the body unit 110 may be temporarily fixed by the power supply units 144 and the open holes 123 and thus assembly efficiency therebetween is improved.

The power supply units 144 protruding from the open holes 123 come into contact with the electrode units 15 and thus receive power supplied from the electrode units 15. Here, the power supply units 144 have electricity due to a bent shape thereof and apply pressure to the electrode units 15, thus maintaining a stable contact state.

The lighting unit 145 includes light sources 146 provided on the substrate 142 and a diffuser 147 coupled to the housing 111 to diffuse light from the light sources 146. The light source 146 may include one luminous body configured to emit light. The luminous body constituting the light source 146 may be at least one of a light emitting diode (LED) or an organic OLED.

The plurality of light sources 146 in accordance with one embodiment are installed on the lower part of the substrate 142, and the diffuser 147 forms a curved surface, which is concave upwards, and extends in a length direction of the housing 111. The diffuser 147 diffuses light generated from the light sources 146 and thus implements a function of diffusing light to an object to be lit up. Since the module unit 140 having the diffuser 147 is detachably installed under the housing 111, maintenance of the module unit 140 may be easily carried out.

The fixing unit 300 may be installed at one side or the other side of the body unit 110 or be installed at both sides of the body unit 110. The fixing unit 300 restrains the movement of the body unit 110 along the rail unit 10 and thus guides stable installation of the body unit 110. The fixing unit 300 in accordance with one embodiment includes the coupling unit 120 configured to restrain the movement of the body unit 110 connected to the rail unit 10 and to guide power of the rail unit 10 to be supplied to the body unit 110 and includes an insert body unit 130 connected to the body unit 110 or the coupling unit 120 to reinforce coupling force between the coupling unit 120 and the rail unit 10 in association with the coupling unit 120.

As shown in FIGS. 2 to 6, the coupling unit 120 may be formed to have any shape within the scope of technical ideas in which the coupling unit 120 may restrain the movement of the body unit 110 connected to the rail unit 10 and guide power of the rail unit 10 to be supplied to the body unit 110. The coupling unit 120 in accordance with one embodiment includes the coupling body 122, side wall parts 124, the engaging protrusions 125, and connection members 126.

The coupling body 122 is coupled to one or the other side or coupled to both sides of the body unit 110. The side surfaces of the coupling body 122 facing the module unit 140 form grooves, and thus the substrate 142 of the module unit 140 is inserted into the coupling body 122. The power supply units 144 protruding upward from the substrate 142 protrude upwards through the open holes 123 provided on the upper surface of the coupling body 122 and come into contact with the electrode units 15 of the rail unit 10.

The side wall parts 124 are provided to be spaced apart from the coupling body 122 and form plates which stand erect at both sides of the coupling body 122. Since the insert body unit 130 is moved to receiving spaces S formed between the side wall parts 124 and the coupling body 122, the side wall parts 124 are engaged with the engaged parts 14 of the rail unit 10 and thus are fixed to the rail unit 10 together with the body unit 110. The coupling unit 120 may further include the connection members 126 configured to connect the side wall parts 124 to the coupling body 122.

Therefore, the side wall parts 124 are provided to be rotated about the connection members 126 in association with external force.

The receiving spaces S are formed between the coupling body 122 and the side wall parts 124 to receive the insert body unit 130. The insert body unit 130 is moved to the insides and the outsides of the receiving spaces S and applies pressure to the side wall parts 124 to fix the side wall parts 124 to the rail unit 10. Interference members 134 of the insert body unit 130 apply pressure to the side wall parts 124, and thus, the side wall parts 124 maintain a fixed state to the engaged parts 14 of the rail unit 10. The side wall parts 124 are elastically pressed against the rail unit 10 through the insert body unit 130 to be fixed to the rail unit 10 when the side wall parts 124 are in a stage of being engaged with the insert body unit 130.

Since the lower part of the coupling unit 120 becomes widened and the upper part of the coupling unit 120 is pressed against the rail unit 10 by the insert body unit 130 received in the receiving spaces S formed between the coupling body 122 and the side wall parts 124, the coupling unit 120 may be more firmly coupled to the rail unit 10. The engaging protrusion 125 having a bending member 128 is formed at one end of each of the side wall parts 124, and thus the engaging protrusions 125 may maintain a state of being stably fixed to the engaged parts 14 of the rail unit 10.

The engaged parts 14 are formed at the edge of the rail unit 10 to be bound to the side wall parts 124, and the engaging protrusions 125 which are bent inwards to be engaged with the engaged parts 14 are formed at the ends of the side wall parts 124. The bending members 128 forming an obtuse angle are provided at the upper ends of the engaging protrusions 125 engaged with the engaged parts 14. Therefore, when the engaging protrusions 125 are pushed by the insert body unit 130 and thus rotated under the condition that the engaging protrusions 125 are engaged with grooves of the engaged parts 14, interference of the engaging protrusions 125 with the engaged parts 14 may be prevented due to the shape of the bending members 128. Otherwise, under the condition that the engaging protrusions 125 are inserted into the engaged parts 14, operating spaces between the engaging protrusions 125 and the inner surface of the engaged parts 14 are secured, and thus, interference of the engaging protrusions 125 with the engaged parts 14 may be prevented.

The connection members 126 are provided between the coupling body 122 and the side wall parts 124 and control coupling force of the side wall parts 124. In this embodiment, the connection members 126 are members which are formed integrally with the central regions of the side wall parts 124 and the outer surface of the coupling body 122 and facilitate rotary motion of the side wall parts 124. The side wall parts 124 are rotated about the connection members 126 in association with external force, and have elasticity. Therefore, when force is applied to the lower ends of the side wall parts 124 based on the connection members 126, the upper regions of the side wall parts 124 become farther away from each other and, when the applied force is released, the upper regions of the side wall parts 124 are restored to their original state and thus apply pressure to the rail unit 10, and thus, the side wall parts 124 may be coupled to the engaged parts by the engaging protrusions 125 formed at the ends of the side wall parts 124.

The insert body unit 130 is coupled to the body unit 110 or the coupling unit 120 to be rotatable, or is coupled to the body unit 110 or the coupling unit 120 to be slidably movable. The insert body unit 130 may be formed to have any shape within the scope of technical ideas in which the insert body unit 130 may improve coupling force of the side wall parts 124 to the rail unit 10 in conjunction with the side wall parts 124 and be inserted into the spaces between the coupling body 122 and the side wall parts 124 so that the engaging protrusions 125 provided at the ends of the side wall parts 124 are engaged with the engaged parts 14 of the rail unit 10. The insert body unit 130 in accordance with one embodiment includes a movable member 132 connected to the body unit 110 or the coupling body 122, and the interference members 134 extending from the movable member 132 and inserted into the spaces between the side wall parts 124 and the coupling body 122 to rotate the side wall parts 124. The side wall parts 124 may be rotated by elasticity thereof without the connection members 126, or be rotated about the connection members 126 when the side wall parts 124 are connected to the connection members 126.

By inserting the interference members 134 into the spaces between the coupling body 122 and the side wall parts 124 due to the movement of the movable member 132, designated ends of the side wall parts 124 become far away from each other, and the other ends of the side wall parts 124 become close to each other, thus reinforcing coupling between the rail unit 10 and the side wall parts 124.

The movable member 132 is hinge-connected to both ends of the body unit 110 and is rotated. As shown in FIG. 6, the movable member 132 may be rotated from the body unit 110, and the interference members 134 may be inserted into spaces between the coupling body 122 and the lower ends of the side wall parts 124 by rotation of the movable member 132. Therefore, the engaging protrusions 125 of the side wall parts 124 may be pressed against the rail unit 10 to be firmly fixed. The movable member 132 in accordance with one embodiment is hinge-connected to each end of the body unit 110 and thus rotated.

Figure 8:
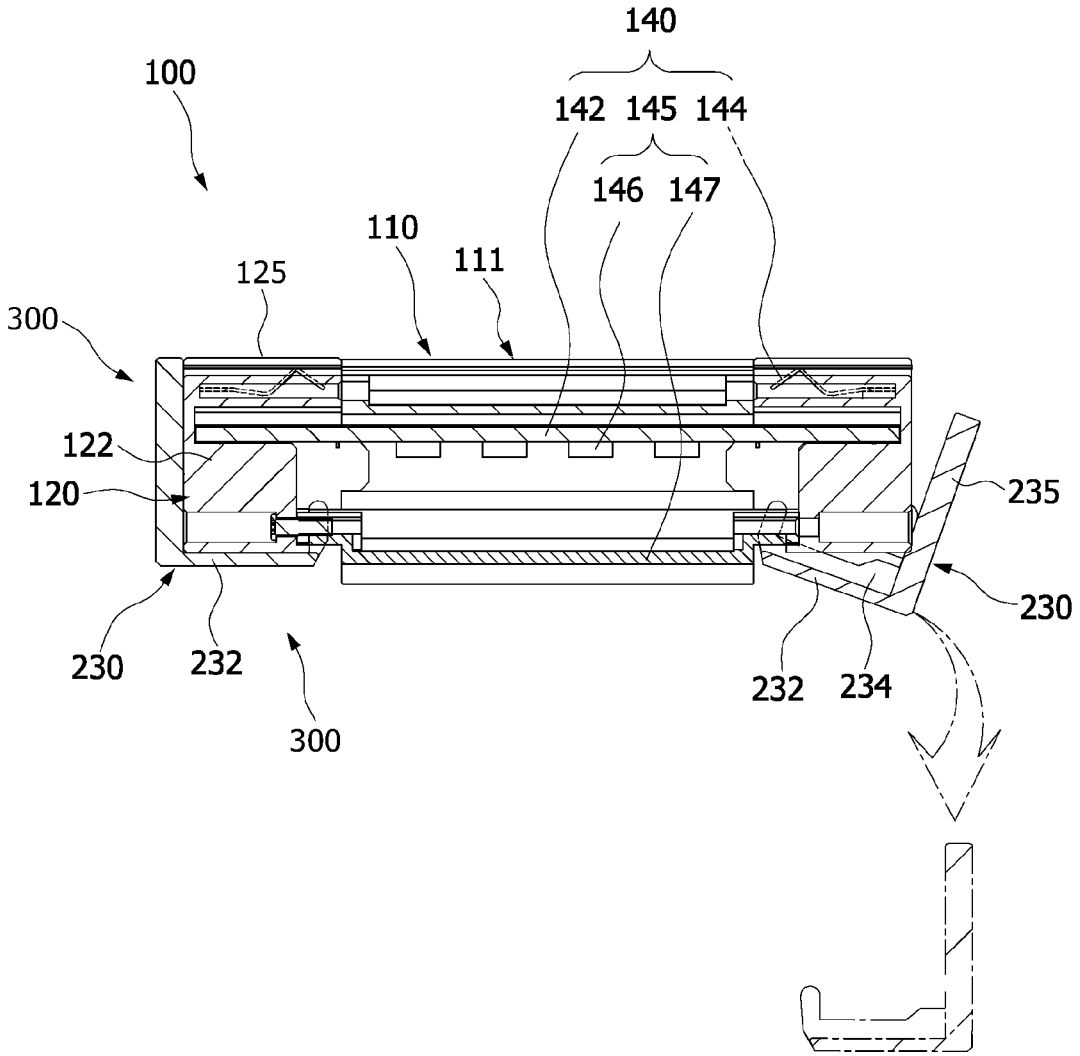
FIG. 8 is a view illustrating a first modified example of the insert body unit of the lighting device in accordance with one embodiment of the present invention.

FIG. 8 is a view illustrating a first modified example of the insert body unit of the lighting device in accordance with one embodiment of the present invention. Referring to FIG. 8, an insert body unit 230 further includes a cover member 235 provided on a movable member 232 to cover the side surface of the coupling unit 120. That is, the cover member 235 is formed to be bent upward from the movable member 232 to form an L-shaped cross-section. Therefore, interference members 234 are inserted into the spaces between the side wall parts 124 and the coupling body 122 by rotation of the movable member 232 to press the upper ends of the side wall parts 134 against the rail unit 10, and the cover member 235 covers the side surface of the coupling unit 120 to cover gaps between the coupling body 122 and the side wall parts 124, thus forming an elegant appearance of the lighting device. The configuration and operation of the insert body unit in which the interference members 234 are inserted into the spaces between the side wall parts 124 and the coupling body 122 to press the upper ends of the side wall parts 134 to the rail unit 10 are the same as those of the insert body unit 130 in accordance with one embodiment of the present invention and a detailed description thereof will thus be omitted.

Figure 9:
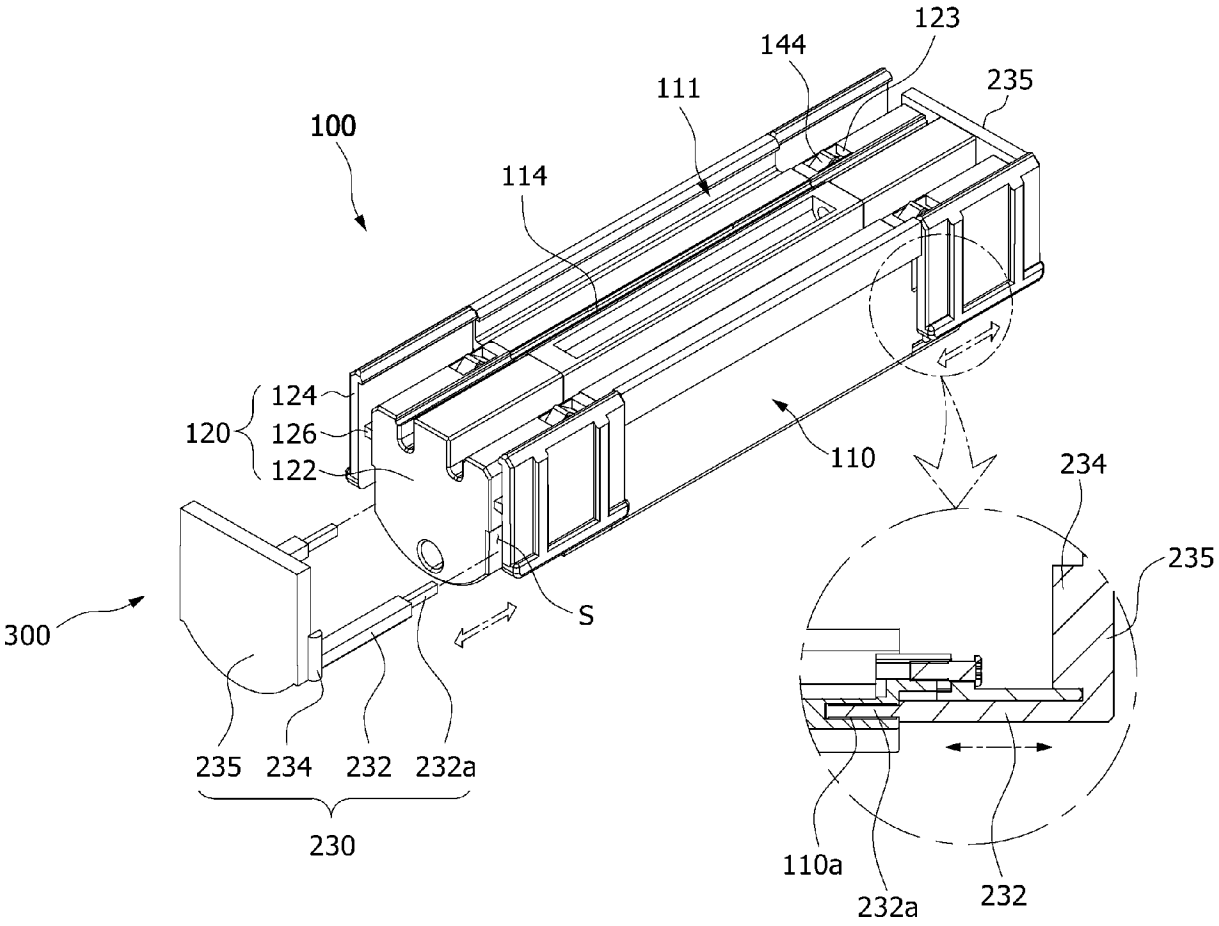
FIG. 9 is a view illustrating a second modified example of the insert body unit of the lighting device in accordance with one embodiment of the present invention.

FIG. 9 is a view illustrating a second modified example of the insert body unit of the lighting device 100 in accordance with one embodiment of the present invention. Referring to FIG. 9, movable members 232 of an insert body unit 230 are coupled to each end of the body unit 110 to be slidably movable. That is, guide grooves 110*a* are formed in the body unit 110, and the movable members 232 are provided with guide shafts 232*a* to be movable along the guide grooves

110*a* in the length direction of the body unit 110. Therefore, interference members 234 may be inserted into or separated from the spaces between the coupling body 122 and the side wall parts 124 according to sliding movement of the movable members 232. Here, the interference members 234 are formed in a direction corresponding to the movement direction of the movable members 232.

Figure 10:
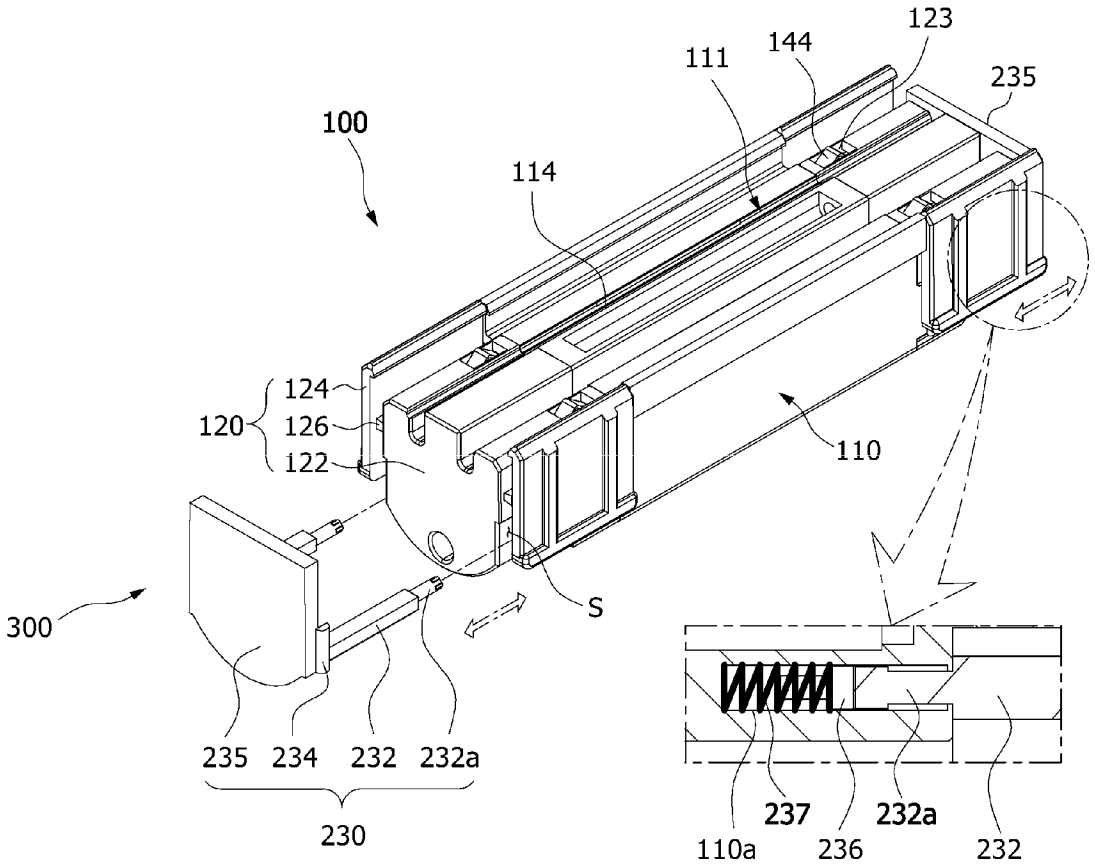
FIG. 10 is a view illustrating a third modified example of the insert body unit of the lighting device in accordance with one embodiment of the present invention.

FIG. 10 is a view illustrating a third modified example of the insert body unit of the lighting device 100 in accordance with one embodiment of the present invention. Referring to FIG. 10, movable members 232 are coupled to each end of the body unit 110 to be slidably movable in the same manner as the second modified example, and the movable members 232 may be moved semi-automatically. That is, the movable members 232 are provided with guide shafts 232*a*, and guide grooves 110*a* configured to receive the guide shafts 232*a* are formed in the body unit 110. An operation member 236 supported by an elastic member 237 to selectively push the guide shaft 232*a* is provided in the guide groove 110*a*. Such an operation member 236, which is applied to a ballpoint pen or the like, is well-known technology and thus a detailed description thereof will be omitted. Of course, various modifications of a structure to selectively fix a moved state of the movable member 232 toward the coupling unit 120 are possible. Interference members 234 may be inserted into or semi-automatically separated from the spaces between the coupling body 122 and the side wall parts 124 according to the above-described sliding movement of the movable members 232.

Figure 11:
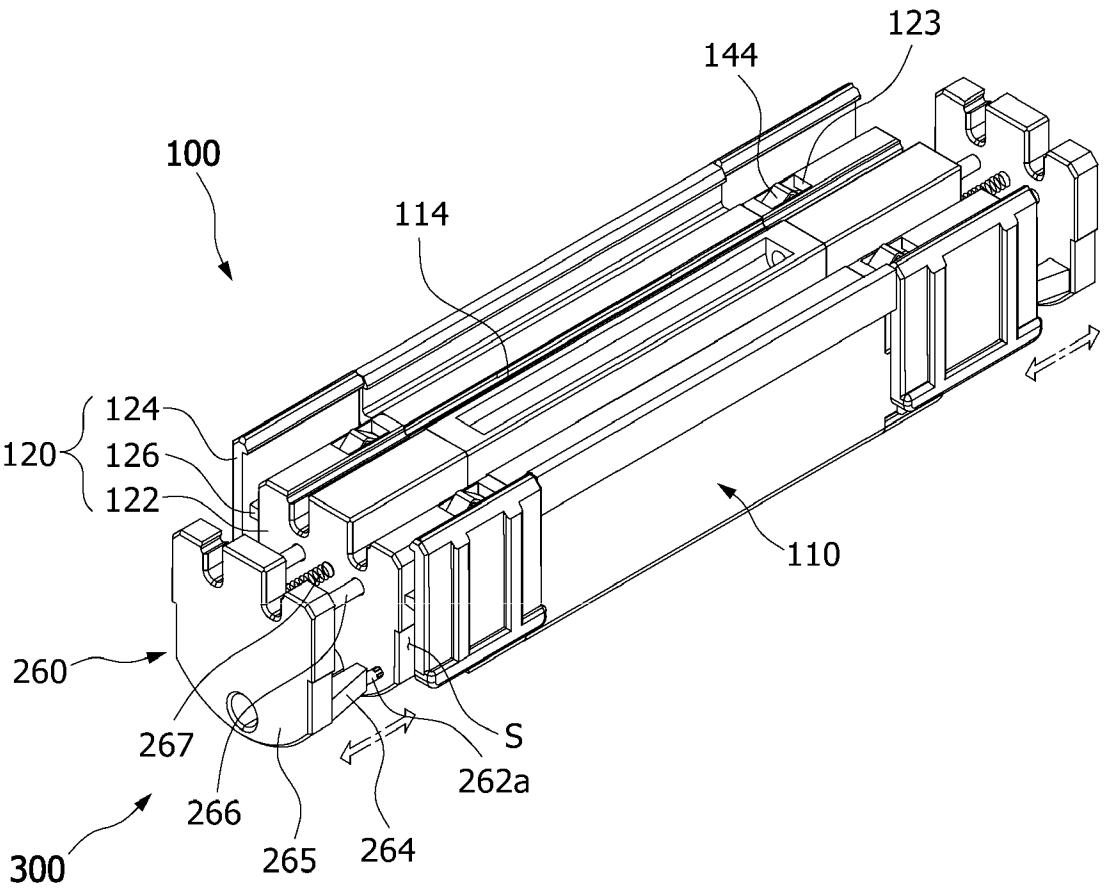
FIG. 11 is a view illustrating a fourth modified example of the insert body unit of the lighting device in accordance with one embodiment of the present invention.

FIG. 11 is a view illustrating a fourth modified example of the insert body unit of the lighting device in accordance with one embodiment of the present invention. Referring to FIG. 11, an insert body unit 260 is installed at a side part of the coupling body 122 forming the body of the coupling unit 120 to be slidably movable. Guide shafts 262*a* extending from the insert body unit 260 toward the coupling body 122 extends toward the inside of the coupling body 122 and thus guide sideward sliding movement of the insert body unit 260. Interference members 264 extending from the insert body unit 260 and inserted into the spaces between the side wall parts 124 and the coupling body 122 are formed to have a wedge shape and rotate the side wall parts 124 to fix the engaging protrusions 125 to the engaged parts 14. The interference member 264 has a tapered shape, the width of which is gradually increased from one side (the right side in FIG. 11) of the interference member 264 to the other side (the left side in FIG. 11). Therefore, when the interference members 264 are inserted into the spaces formed between the side wall parts 124 and the coupling body 122, one side of each of the interference members 264 having a relatively small width is inserted into the space formed between the side wall part 124 and the coupling body 122. Further, bodies of the interference members 264 having a gradually increased width are inserted into the spaces formed between the side wall parts 124 and the coupling body 122 according to the movement of the insert body unit 260, and thus, the side wall parts 124 become effectively farther away from each other.

The guide shafts 262*a*, each of which protrudes from one side of each of the interference members 264, are inserted into guide grooves 110*a* provided in the body unit 110 to guide sliding movement, and, as needed, the elastic member 267 and the operation member 236 shown in FIG. 10 may be additionally installed in the guide grooves 110*a* of the body unit 110.

A cover member 265 connected to the interference members 264 has a plate shape facing the coupling body 122 and is installed in an erect state. Guide rods 266 extending from the cover member 265 are inserted into the coupling body 122 and slidably moved together with the cover member 265. Further, the cover member 265 and the coupling body 122 are connected by an elastic member 267 using a coiled spring. The elastic member 267 elastically applies pressure to the cover member 265 in a direction away from the coupling body 122. Further, the guide shafts 262*a* are inserted into the guide grooves 110*a* formed in the coupling body 122 and thus engaged with the guide grooves 110*a* or such engagement is released with an operation feeling in which the guide shafts 262*a* click into the guide grooves 110*a*. An operation of engaging the guide shafts 262*a* with the guide grooves 110*a* or releasing such engagement is the same as or similar to in a locking structure applied to a ballpoint pen and a detailed description thereof will thus be omitted.

Figure 12:
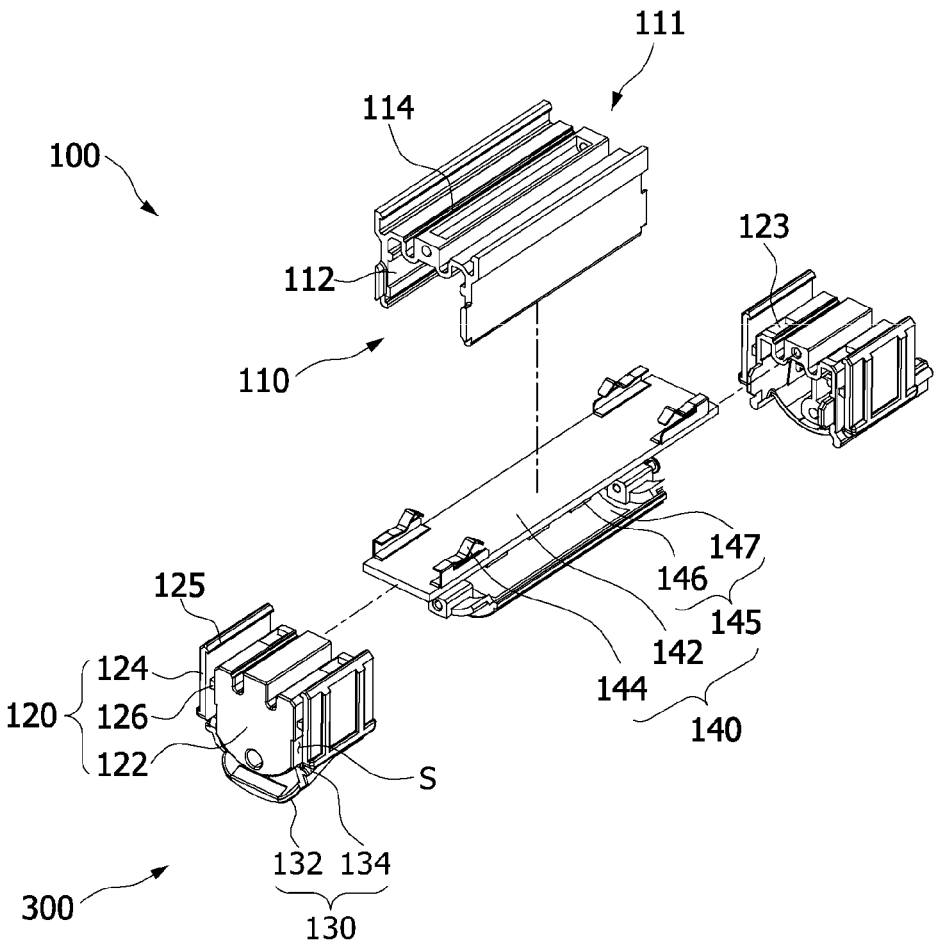
FIG. 12 is a view illustrating a fifth modified example of the insert body unit of the lighting device in accordance with one embodiment of the present invention.

FIG. 12 is a view illustrating a fifth modified example of the insert body unit of the lighting device in accordance with one embodiment of the present invention. As shown in FIG. 12, an insert body unit 130 is connected to the lower part of the coupling unit 120 to be rotatable. A movable member 132 constituting the insert body unit 130 is rotatably connected to the lower part of the coupling body 122 and, when the movable member 132 is rotated to surround the lower part of the coupling body 122, interference members 134 connected to the movable member 132 are inserted into the spaces formed between the side wall parts 124 and the coupling body 122 and apply pressure to the side wall parts 124, and thus, the engaging protrusions 125 connected to the upper ends of the side wall parts 124 are inserted and engaged with the engaged parts 14 of the rail unit 10.

Figure 13:
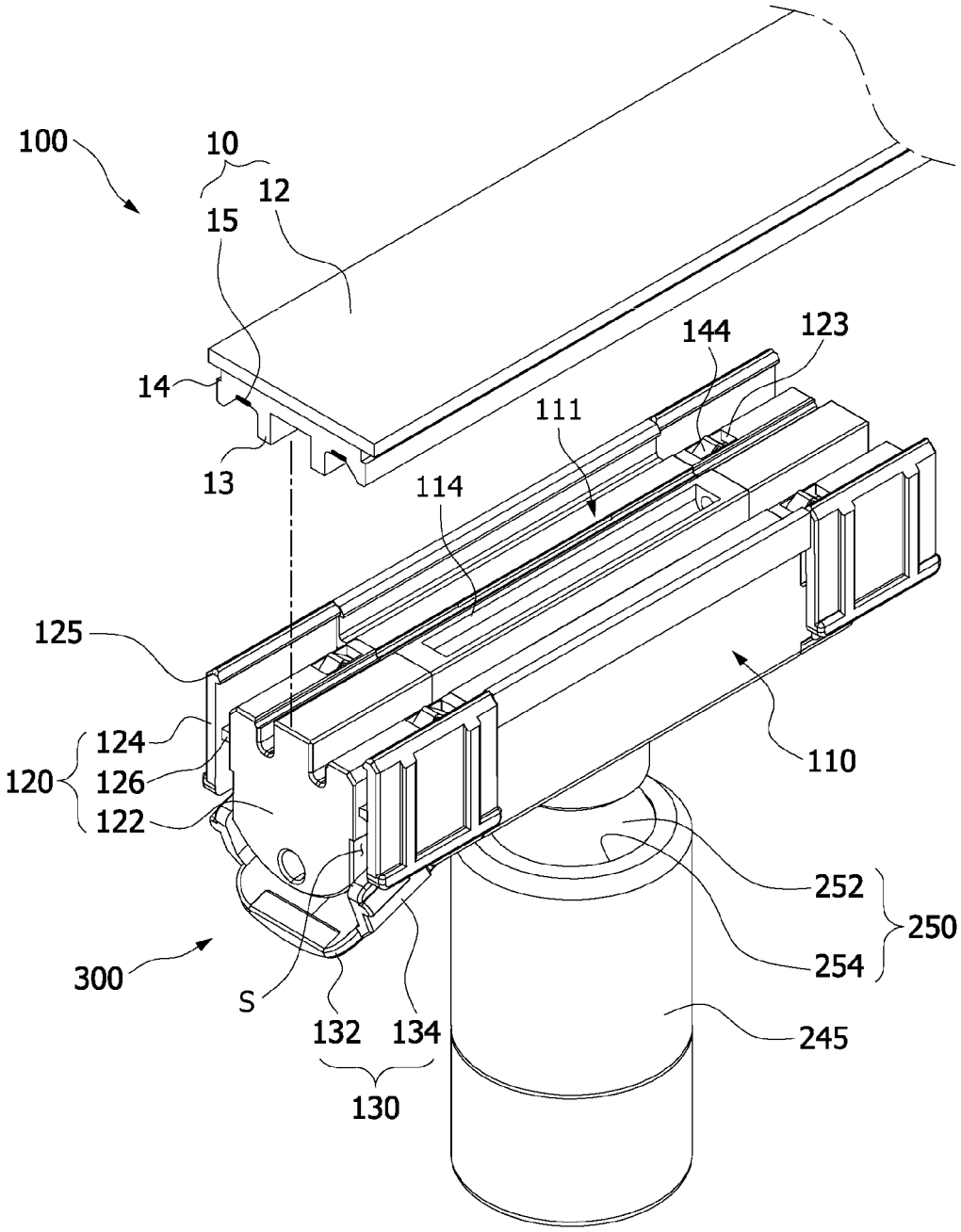
FIGS. 13 and 14 are views illustrating a modified example of a module unit of the lighting device in accordance with one embodiment of the present invention.
Figure 14:
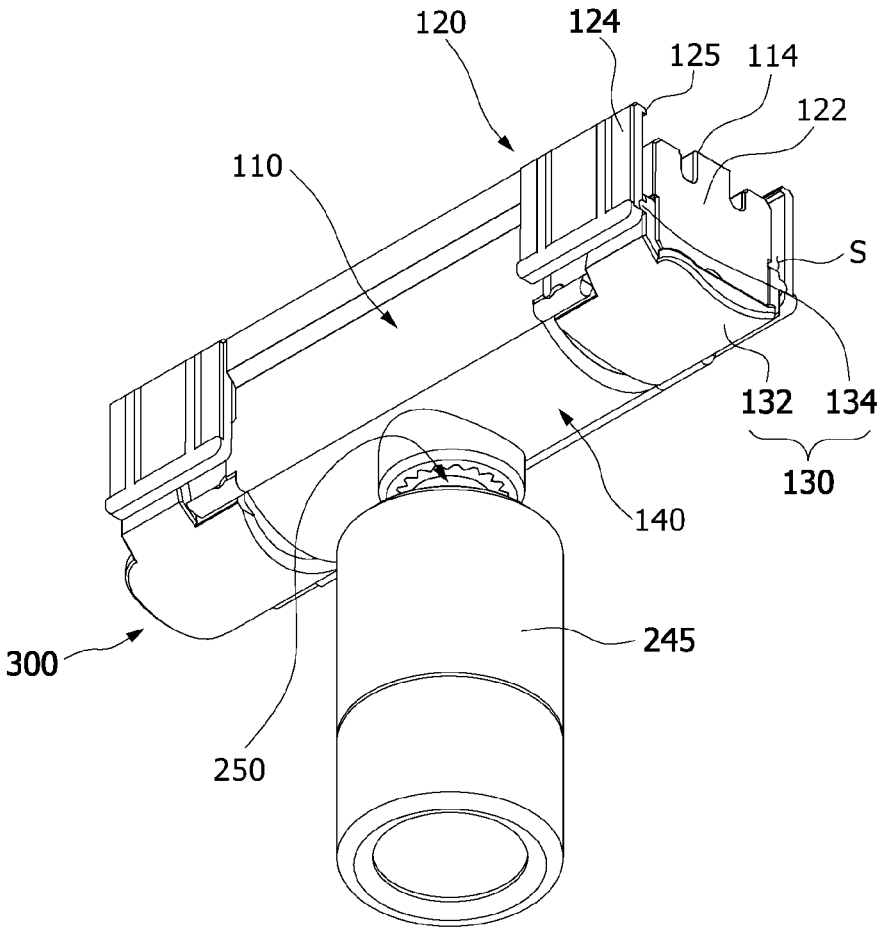

FIGS. 13 and 14 are views illustrating a modified example of the module unit of the lighting device in accordance with one embodiment of the present invention. As shown in FIGS. 13 and 14, a lighting unit 245 may emit light to a specific region desired by a user. Such a lighting unit 245 is provided to be rotatable by a rotation unit 250. The rotation unit 250 is provided on the body unit 110 and includes a ball member 252 and a rotation hole part 254 provided on the lighting unit 245 to couple the ball member 252 to the rotation hole part 254. Here, the ball member 252 may be screw-coupled to the body unit 110 to be detachable from the body unit 110.

Although this embodiment illustrates the module unit 140 as the lighting unit 145 or 245 having a lighting function, the present invention is not limited thereto, and the module unit 140 may be variously modified into a display panel which may provide an image, a power distribution device which may be electrically connected to an external apparatus, etc.

Figure 15:
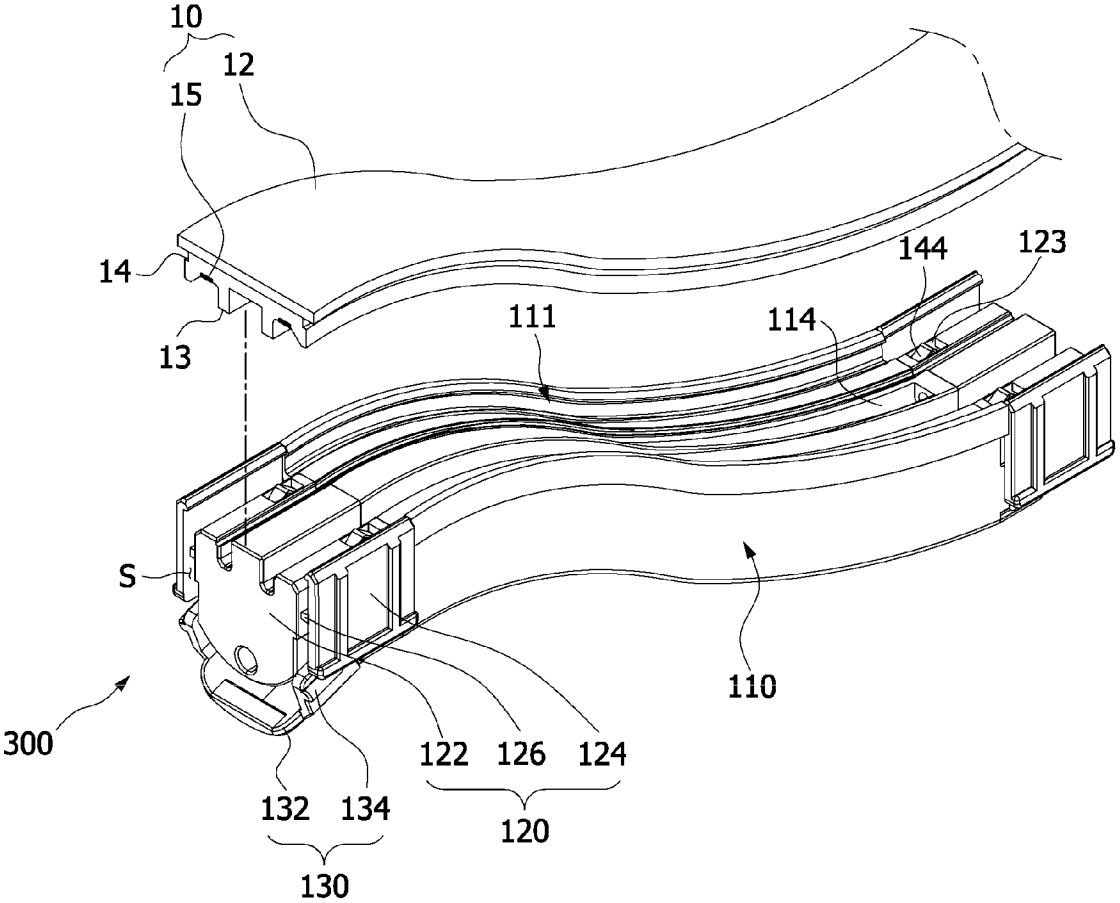
FIG. 15 is a view illustrating a modified example of the lighting device in accordance with one embodiment of the present invention.

Further, FIG. 15 is a view illustrating a modified example of the lighting device 100 in accordance with one embodiment of the present invention. Referring to FIG. 15, shapes of a rail unit 10 and a body unit 110 coupled to the rail unit 10 may be variously modified. That is, the rail unit 10 and the body unit 110 may be formed to have a curved shape, and a coupling unit 120 may be coupled to each end of the body unit 110, thus creating a different interior atmosphere.

Figure 16:
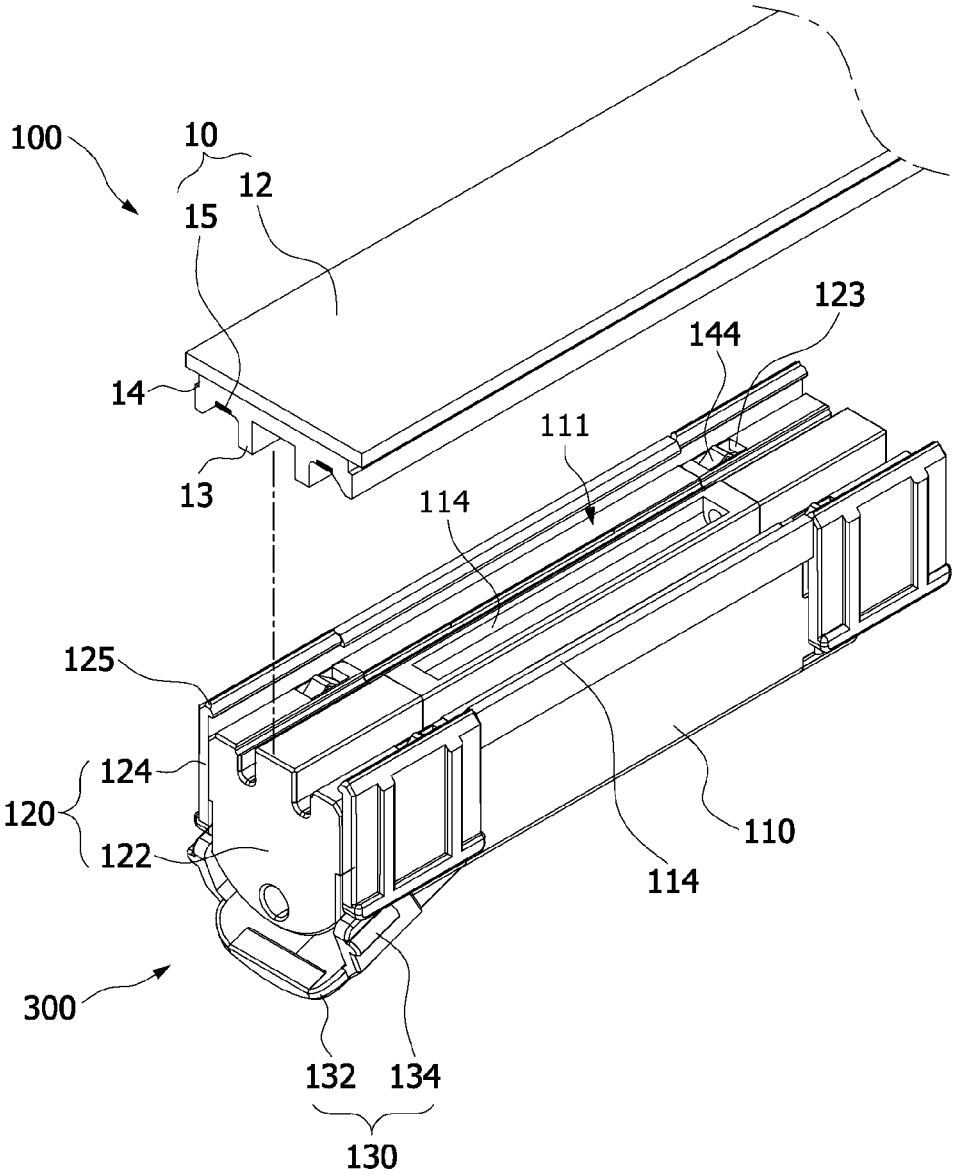
FIG. 16 is a view illustrating a modified example of the coupling unit in accordance with one embodiment of the present invention.

FIG. 16 is a view illustrating a modified example of the coupling unit in accordance with one embodiment of the present invention. As shown in FIG. 16, side wall parts 124 are connected directly to a coupling body 122 without connection members 126. The side wall parts 124 have a plate shape with elasticity, and engaging protrusions 125 connected to the upper ends of the side wall parts 124 are moved by elastic deformation of the side wall parts 124 and engaged with the engaged parts 14 of the rail unit 10.

Further, the shape of the side wall parts 124 is deformed by interference members 264 inserted into the spaces between the lower regions of the side wall parts 124 and the coupling body 122, and thus, pressure may be applied to the side wall parts 124 in a direction in which the upper regions of the side wall parts 124 come into contact with the engaged parts 14 of the rail unit 10.

Hereinafter, an operating state of the lighting device in accordance with one embodiment of the present invention will be described in detail with reference to the accompanying drawings.

The body unit 110 having the lighting unit 145 is installed on the rail unit 10 mounted on a structure such as a ceiling of a building or the like. The installation position of the body unit 110 may be changed in the length direction of the rail unit 10, and a user may easily adjust the position of the body unit 110 to a region requiring illumination.

Installation of and supplying power to the above-described body unit 110 having the lighting unit 145 may be carried out by a connection structure which will be described below. Power supplied from an external power supply device (not shown) is supplied to the electrode units 15 by electric wires (not shown) or the like configured to connect the external power supply device and the electrode units 15.

The body unit 110 having the lighting unit 145 is coupled to the guide rail unit 12 by the fixing unit 300. That is, when pressure is applied to the body unit 110 in an upward direction from the lower part of the guide rail unit 12, the engaging protrusions 125 of the side wall parts 124 of the coupling unit 120 are coupled to the engaged parts 14 formed at both edges of the guide rail unit 12 while surrounding the engaged parts 14. Due to such a coupling structure, the body unit 110 is installed to be movable along the guide rail unit 12. Since the guide groove part 114 is formed on the upper surface of the body unit 110 and the guide protrusions 13 are formed on the bottom surface of the guide rail unit 12 so that the guide groove part 114 and the guide protrusions 13 correspond to each other, the body unit 110 may be stably moved along the guide rail unit 12 when the body unit 110 is moved.

When the body unit 110 is coupled to the rail unit 10 in this way, the power supply units 144 which are exposed from the open holes 123 are electrically connected to the electrode units 15 by contact between the power supply units 144 and the electrode units 15. The power supply units 144 may receive power through the electrode units 15 at any position in the length direction of the rail unit 10, on which the electrode units 15 are installed, by such connection between the power supply units 144 and the electrode units 15.

The power supply units 144 having received power supply power to the substrate 142 to supply power to the light sources 146 electrically connected to the substrate 142. That is, the light sources 146 having received power from the power supply units 144 are turned on and the diffuser 147 diffuses light emitted from the light sources 146, thus effectively implementing illumination regardless of position change of the body unit 110.

The coupling unit 120 may strengthen a coupling state with the body unit 110 by the insert body unit 130. As shown in FIGS. 5 and 6, when the movable members 132 hinge-connected to both ends of the body unit 110 are moved, the interference members 134 bent from the movable members 132 are inserted into the spaces between the coupling body 122 and the side wall parts 124. That is, since the interference members 134 are inserted into the spaces between the coupling body 122 and the lower ends of the side wall parts 124, the side wall parts 124 are rotated about the connection members 126 by the thickness of the interference members 134, and thereby, the lower ends of the side wall parts 124 are far away from each other in the outward direction and the upper ends of the side wall parts 124 apply pressure to the engaged parts 14 of the guide rail unit 12 and are thus firmly fixed. Since, as such, binding between the side wall parts 124 and the engaged parts 14 may be strengthened by rotation of the movable member 132, separation of the lighting device 100 from the rail unit 10 due to release of binding between the side wall parts 124 and the engaged parts 14 may be prevented, and unintended position change of the lighting device 100 may be prevented.

Further, as shown in FIG. 8, the cover member 235 configured to cover the side surface of the coupling unit 120 may be connected to the movable member 232, thus forming an elegant appearance. Further, as shown in FIGS. 9 and 10, the guide shafts 232*a* of the movable member 232 may be moved along the guide grooves 110*a*, and the reference members 234 provided on the movable member 232 may be inserted into the spaces between the coupling body 122 and the side wall parts 124 and thus reinforce coupling of the coupling unit 130 to the body unit. Particularly, in FIG. 10, the movable members 232 may be semi-automatically moved by the operation members 236, which are supported by the elastic members 237 and selectively fix the position of the movable members 232, thus providing convenience of use.

As shown in FIG. 11, the insert body unit 260 may be installed at the side surface of the coupling body 122 to be slidably movable, and the interference members 264 may be moved along the insert body unit 260 and inserted into the receiving spaces S to rotate the side wall parts 124. The insert body unit 260 and the coupling unit 120 form one module, and thus, management and assembly of parts may be easily carried out.

Further, as shown in FIG. 12, the insert body unit 130 may be installed at the lower part of the coupling unit 120 to be rotatable, and thus, even when the shape of the lighting unit 145 is changed, the fixing unit 300 may be used and thus production cost may be cut down.

As shown in FIGS. 13 and 14, the lighting unit 245 may be formed as a spot lighting unit and be rotated by the rotation unit 250 to illuminate a specific space desired by a user, and, although not shown in the drawings, various module units 140, such as a display panel which may provide an image or the like, may be applied.

As shown in FIG. 15, the shapes of the rail unit 10 and the body unit 110 coupled to the rail unit 10 may be variously modified, thus creating various interior atmospheres.

Further, as shown in FIG. 16, the structure, in which the side wall parts 124 are connected directly to the coupling body 122 without separate connection members 126, and the engaging protrusions 125 connected to the upper ends of the side wall parts 124 are engaged with the engaged parts 14 of the rail unit 10 by elasticity of the side wall parts 124, may be used. Since the regions of the side wall parts 124 connected to the coupling body 122 have elasticity, when the side wall parts 124 are rotatable, the interference members 134 of the insert body unit 130 are inserted into the spaces between the side wall parts 124 and the coupling body 122 and rotate the side wall parts 124, and thus the engaging protrusions 125 are engaged with the engaged parts 14 of the rail unit 10 and restrain the movement of the side wall parts 124.

As is apparent from the above description, since the lighting device in accordance with the present invention can stably receive power, the lighting device can illuminate a plurality of positions or a wide area and provide light of high brightness concentratedly or selectively to a position requiring illumination. Further, the lighting device in accordance with the present invention can maintain a neat and simple appearance while stably receiving power and reduce an influence of interference with appendages, such as electric wires or the like during installation of the module unit 140. Moreover, since the lighting device in accordance with the present invention can firmly maintain a coupling state between the rail unit 10 and the coupling unit 120 due to the insert body unit 130 provided on the body unit 110, the lighting device can facilitate stable power connection and prevent accidents generated due to separation of the body unit 110.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A lighting device comprising:

a rail unit;

a body unit configured to emit light to an object to be lit up and coupled to the rail unit; and a fixing unit fixed to the rail unit together with the body unit and configured to guide power of the rail unit to be supplied to the body unit, wherein the fixing unit comprises:

a coupling unit configured to restrain the movement of the body unit connected to the rail unit and to guide the power of the rail unit to be supplied to the body unit; and an insert body unit connected to the body unit or the coupling unit and configured to reinforce coupling force between the coupling unit and the rail unit in association with the coupling unit, wherein the coupling unit comprises:

a coupling body coupled to the body unit; and side wall parts provided to be spaced apart from the coupling body; and connection members configured to connect the side wall parts to the coupling body, wherein the insert body unit is moved into receiving spaces formed between the side wall parts and the coupling body; and the side wall parts are provided to be rotated about the connection members in association with external force.

2. The lighting device of claim 1, wherein the rail unit comprises:

a guide rail unit coupled to the body unit; and an electrode unit installed on the guide rail unit and configured to come into contact with a power supply unit provided on the body unit to supply power to the power supply unit.

3. The lighting device of claim 2, wherein the guide rail unit comprises:

guide protrusions configured to form a groove into which a guide groove part protruding upward from the body unit is inserted; and engaged parts located at both sides of the guide protrusions and configured to form grooves with which engaging protrusions of the fixing unit are engaged.

4. The lighting device of claim 1, wherein the body unit comprises:

a housing coupled to the rail unit;

a substrate detachably installed on the housing;

a power supply unit connected to the substrate and configured to come into contact with the rail unit to receive power; and a lighting unit electrically connected to the substrate and configured to emit light.

5. The lighting device of claim 4, further comprising a rotation unit by which the lighting unit is rotatable.

6. The lighting device of claim 1, wherein the insert body unit comprises:

a movable member connected to the body unit or the coupling body; and interference members configured to extend from the movable member and inserted into the receiving spaces formed between the side wall parts and the coupling body to rotate the side wall parts.

7. The lighting device of claim 6, wherein the movable member is hinge-connected to each end of the body unit and rotated.

8. A lighting device comprising:

a rail unit;

a body unit configured to emit light to an object to be lit up and coupled to the rail unit; and a fixing unit fixed to the rail unit together with the body unit and configured to guide power of the rail unit to be supplied to the body unit, wherein the fixing unit comprises:

a coupling unit configured to restrain the movement of the body unit connected to the rail unit and to guide the power of the rail unit to be supplied to the body unit; and an insert body unit connected to the body unit or the coupling unit and configured to reinforce coupling force between the coupling unit and the rail unit in association with the coupling unit, wherein the coupling unit comprises:

a coupling body coupled to the body unit; and side wall parts provided to be spaced apart from the coupling body, wherein the insert body unit is moved into receiving spaces formed between the side wall parts and the coupling body, wherein the insert body unit is inserted into the receiving spaces formed between the side wall parts and the coupling body so that engaging protrusions provided at ends of the side wall parts are engaged with engaged parts of the rail unit.

9. A lighting device comprising:

a rail unit;

a body unit configured to emit light to an object to be lit up and coupled to the rail unit; and a fixing unit fixed to the rail unit together with the body unit and configured to guide power of the rail unit to be supplied to the body unit, wherein the fixing unit comprises:

a coupling unit configured to restrain the movement of the body unit connected to the rail unit and to guide the power of the rail unit to be supplied to the body unit; and an insert body unit connected to the body unit or the coupling unit and configured to reinforce coupling force between the coupling unit and the rail unit in association with the coupling unit, wherein the coupling unit comprises:

a coupling body coupled to the body unit; and side wall parts provided to be spaced apart from the coupling body, wherein the insert body unit is moved into receiving spaces formed between the side wall parts and the coupling body, wherein the insert body unit comprises:

a movable member connected to the body unit or the coupling body; and interference members configured to extend from the movable member and inserted into the receiving spaces formed between the side wall parts and the coupling body to rotate the side wall parts.

10. The lighting device of claim 9, wherein the movable member is hinge-connected to each end of the body unit and rotated.

11. The lighting device of claim 9, wherein the movable member is coupled to each end of the body unit to be slidably movable.

12. The lighting device of claim 9, wherein the insert body unit further comprises a cover member connected to the movable member and configured to cover a side surface of the coupling unit.

* * * * *